US011837128B2

(12) United States Patent
Kim et al.

(10) Patent No.: US 11,837,128 B2
(45) Date of Patent: Dec. 5, 2023

(54) DISPLAY DEVICE, SENSING-LESS COMPENSATING SYSTEM AND METHOD FOR COMPRESSING DATA THEREOF

(71) Applicant: LG DISPLAY CO., LTD., Seoul (KR)

(72) Inventors: Jihwan Kim, Seoul (KR); Seho Lim, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/873,743

(22) Filed: Jul. 26, 2022

(65) Prior Publication Data

US 2023/0065092 A1 Mar. 2, 2023

(30) Foreign Application Priority Data

Aug. 27, 2021 (KR) ..... 10-2021-0114216

(51) Int. Cl.
*G09G 3/00* (2006.01)
*G09G 3/3291* (2016.01)

(52) U.S. Cl.
CPC ..... *G09G 3/006* (2013.01); *G09G 3/3291* (2013.01); *G09G 2320/045* (2013.01); *G09G 2330/02* (2013.01); *G09G 2340/14* (2013.01)

(58) Field of Classification Search
CPC ..... G09G 3/006; G09G 3/3291; G09G 3/3233
See application file for complete search history.

(56) References Cited

U.S. PATENT DOCUMENTS

| | | | | |
|---|---|---|---|---|
| 10,803,791 | B2 * | 10/2020 | Mobasher | H04N 19/60 |
| 11,107,415 | B2 * | 8/2021 | Meng | G09G 3/3233 |
| 11,132,944 | B2 * | 9/2021 | Cook | G09G 3/2044 |
| 11,450,249 | B2 * | 9/2022 | Song | G09G 3/006 |
| 2015/0243201 | A1 * | 8/2015 | Chung | G09G 3/3225 345/77 |

* cited by examiner

*Primary Examiner* — Sardis F Azongha
(74) *Attorney, Agent, or Firm* — Morgan, Lewis & Bockius LLP

(57) ABSTRACT

A method for compressing and applying data of the sensing-less compensating system may be provided for a display device having subpixels. As the system can update an accumulated stress data of a subpixel which is accumulated according to a display driving data signal in a real time and perform a compensation, a real time compensation for a degradation of the subpixel can be performed without sensing the subpixel. Furthermore, as the system may provide a bit size information for restoration according to a comparison result of data subject to loss-compress and a loss reference value when loss-compressing the accumulated stress data, a loss ratio of a loss-compression data can be reduced. A display device and a sensing-less compensation system are also disclosed.

18 Claims, 11 Drawing Sheets

*Sensing-less Compensating System*

DISPLAY DEVICE, SENSING-LESS COMPENSATING SYSTEM AND METHOD FOR COMPRESSING DATA THEREOF

CROSS REFERENCE TO RELATED APPLICATION

This application claims the benefit of and priority to Korea Patent Application No. 10-2021-0114216, filed on Aug. 27, 2021, the entirety of which is incorporated herein by reference for all purposes.

BACKGROUND

1. Technical Field

The present disclosure relates to devices and methods and particularly to, for example, without limitation, a display device, a sensing-less compensating system and a method for compressing data of the sensing-less compensating system.

2. Discussion of the Related Art

The growth of the information society leads to increased demand for display devices to display images and use of various types of display devices, such as liquid crystal display devices, organic light emitting display devices, and other types of display devices.

The display device may include a display panel in which a plurality of subpixels are disposed, and various driving circuits for driving the plurality of subpixels. Further, at least one circuit element can be disposed in each of the plurality of subpixels.

As a driving time of the display device increases, a degradation of a circuit element disposed in the subpixel can occur. In addition, the degrees of degradation of the circuit elements disposed in different subpixels can be different from each other.

In the case that the degrees of degradation of the circuit elements disposed in different subpixels are different from each other, a driving deviation (or variation) between subpixels can occur, and a display quality can be diminished due to the driving deviation between subpixels.

Thus, methods are needed to prevent a decrease in display quality due to a degradation of the circuit element disposed in the subpixel and the degradation variation (or deviation) between circuit elements disposed in different subpixels.

The description provided in the discussion of the related art section should not be assumed to be prior art merely because it is mentioned in or associated with that section. The discussion of the related art section may include information that describes one or more aspects of the subject technology.

SUMMARY

The inventors of the present disclosure have recognized the problems and disadvantages of the related art and have performed extensive research and experiments. The inventors of the present disclosure have thus invented new methods that substantially obviate one or more problems due to limitations and disadvantages of the related art.

One or more example embodiments of the present disclosure may provide methods of compensating a degradation of a circuit element disposed in a subpixel of a display panel in real time.

One or more example embodiments of the present disclosure may provide methods of reducing a loss ratio when compressing an accumulated stress data of a circuit element and compressing and storing the accumulated stress data.

One or more example embodiments of the present disclosure may provide a display device including a plurality of subpixels in which a light-emitting element and a driving transistor for driving the light-emitting element are disposed, a data driving circuit configured to supply a data voltage to each of the plurality of subpixels, and a degradation management circuit configured to calculate an accumulated stress data of each of the plurality of subpixels, classify and compress the accumulated stress data as a first type data which is lossless-compressed and a second type data which is loss-compressed, and provide a bit size information for restoration matched to a loss-compressed data.

One or more example embodiments of the present disclosure may provide a sensing-less compensating system for a device having a data driving circuit and a plurality of subpixels. The sensing-less compensation system may include a data signal output unit configured to receive an image data signal, generate a driving data signal based on the image data signal and a compensation data, and output the driving data signal to the data driving circuit, and a degradation management unit configured to calculate an accumulated stress data updated based on an input stress data corresponding to the driving data signal and a pre-stored accumulated stress data, loss-compress a part of the accumulated stress data updated, and provide a bit size information matched to a loss-compressed data. The data driving circuit may supply, to a subpixel of the plurality of subpixels, a data voltage based on a second driving data signal. The data voltage supplied to the subpixel may be based on the accumulated stress data updated.

One or more example embodiments of the present disclosure may provide a method for compressing and applying data of a sensing-less compensating system to a device having a plurality of subpixels. The method may include classifying an accumulated stress data as a first type data for a lossless-compression and a second type data for a loss-compression, comparing the second type data with a loss reference value determined based on the first type data, and generating a bit size information for restoration matched to a loss-compressed data according to a comparison result of the second type data and the loss reference value. A data voltage generated based on the accumulated stress data may be supplied to drive a subpixel of the plurality of sub pixels.

According to various example embodiments of the present disclosure, a degradation of a circuit element disposed in a subpixel can be compensated in real time based on an accumulated stress data for each of subpixels of a display panel.

According to various example embodiments of the present disclosure, as a bit size information for restoration may be provided according to a comparison result of a data loss-compressed and a loss reference value when compressing an accumulated stress data, a loss ratio of a data loss-compressed can be reduced.

Additional features, advantages, and aspects of the present disclosure are set forth in part in the description that follows and in part will become apparent from the present disclosure or may be learned by practice of the inventive concepts provided herein. Other features, advantages, and aspects of the present disclosure may be realized and attained by the descriptions provided in the present disclosure, or derivable therefrom, and the claims hereof as well as the appended drawings. It is intended that all such features, advantages, and aspects be included within this description, be within the scope of the present disclosure, and be protected by the following claims. Nothing in this section should be taken as a limitation on those claims. Further aspects and advantages are discussed below in conjunction with embodiments of the disclosure.

It is to be understood that both the foregoing description and the following description of the present disclosure are exemplary and explanatory, and are intended to provide further explanation of the disclosure as claimed.

BRIEF DESCRIPTION OF THE DRAWINGS

The accompanying drawings, which are included to provide a further understanding of the disclosure, are incorporated in and constitute a part of this disclosure, illustrate embodiments of the disclosure, and together with the description serve to explain principles of the disclosure. In the drawings.

DETAILED DESCRIPTION

Figure 1:
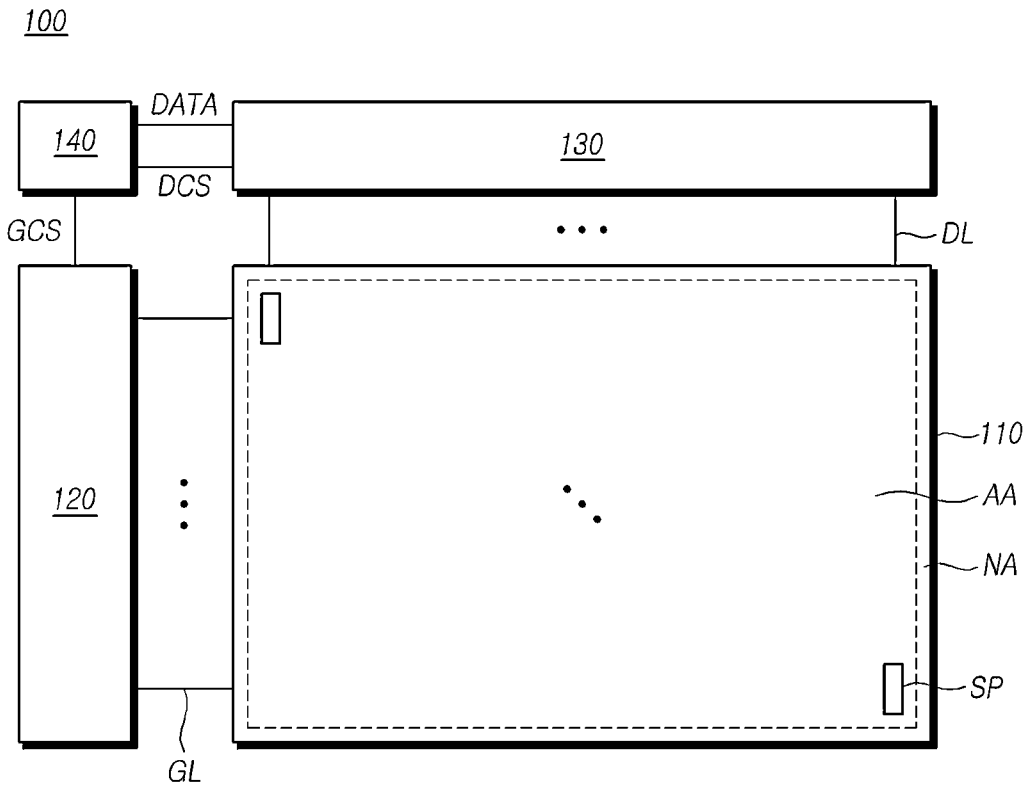
FIG. 1 is a diagram schematically illustrating a configuration of a display device according to example embodiments of the present disclosure.

Reference is now made in detail to embodiments of the present disclosure, examples of which may be illustrated in the accompanying drawings. In the following description, when a detailed description of well-known functions or configurations may unnecessarily obscure aspects of the present disclosure, the detailed description thereof may be omitted. The progression of processing steps and/or operations described is an example; however, the sequence of steps and/or operations is not limited to that set forth herein and may be changed, with the exception of steps and/or operations necessarily occurring in a particular order.

Unless stated otherwise, like reference numerals refer to like elements throughout even when they are shown in different drawings. In one or more aspects, identical elements (or elements with identical names) in different drawings may have the same or substantially the same functions and properties unless stated otherwise. Names of the respective elements used in the following explanations are selected only for convenience and may be thus different from those used in actual products.

Advantages and features of the present disclosure, and implementation methods thereof, are clarified through the embodiments described with reference to the accompanying drawings. The present disclosure may, however, be embodied in different forms and should not be construed as limited to the embodiments set forth herein. Rather, these embodiments are provided so that this disclosure is thorough and complete and fully conveys the scope of the present disclosure to those skilled in the art. Furthermore, the present disclosure is only defined by claims and their equivalents.

The shapes, sizes, areas, ratios, angles, numbers, and the like disclosed in the drawings for describing embodiments of the present disclosure are merely examples, and thus, the present disclosure is not limited to the illustrated details.

When the term "comprise," "have," "include," "contain," "constitute," "make up of," "formed of," or the like is used, one or more other elements may be added unless a term such as "only" or the like is used. The terms used in the present disclosure are merely used in order to describe particular embodiments, and are not intended to limit the scope of the present disclosure. The terms of a singular form may include plural forms unless the context clearly indicates otherwise. The word "exemplary" is used to mean serving as an example or illustration. Any implementation described herein as an "example" is not necessarily to be construed as preferred or advantageous over other implementations.

In one or more aspects, an element, feature, or corresponding information (e.g., a level, range, dimension, size, or the like) is construed as including an error or tolerance range even where no explicit description of such an error or tolerance range is provided. An error or tolerance range may be caused by various factors (e.g., process factors, internal or external impact, noise, or the like). Further, the term "may" fully encompasses all the meanings of the term "can."

In describing a positional relationship, where the positional relationship between two parts is described, for example, using "on," "over," "under," "above," "below," "beneath," "near," "close to," or "adjacent to," "beside," "next to," or the like, one or more other parts may be located between the two parts unless a more limiting term, such as "immediate(ly)," "direct(ly)," or "close(ly)," is used. For example, when a structure is described as being positioned "on," "over," "under," "above," "below," "beneath," "near," "close to," or "adjacent to," "beside," or "next to" another structure, this description should be construed as including a case in which the structures contact each other as well as a case in which one or more additional structures are disposed or interposed therebetween. Furthermore, the terms "front," "rear," "back," "left," "right," "top," "bottom," "downward," "upward," "upper," "lower," "up," "down," "column," "row," "vertical," "horizontal," and the like refer to an arbitrary frame of reference.

In describing a temporal relationship, when the temporal order is described as, for example, "after," "subsequent," "next," "before," "preceding," "prior to," or the like, a case that is not consecutive or not sequential may be included unless a more limiting term, such as "just," "immediate(ly)," or "direct(ly)," is used.

It is understood that, although the term "first," "second," or the like may be used herein to describe various elements, these elements should not be limited by these terms. These terms are only used to distinguish one element from another. For example, a first element could be a second element, and, similarly, a second element could be a first element, without departing from the scope of the present disclosure. Furthermore, the first element, the second element, and the like may be arbitrarily named according to the convenience of those skilled in the art without departing from the scope of the present disclosure. The terms "first," "second," and the like may be used to distinguish components from each other, but the functions or structures of the components are not limited by ordinal numbers or component names in front of the components.

In describing elements of the present disclosure, the terms "first," "second," "A," "B," "(a)," "(b)," or the like may be used. These terms are intended to identify the corresponding element(s) from the other element(s), and these are not used to define the essence, basis, order, or number of the elements.

For the expression that an element or layer is "connected," "coupled," or "adhered" to another element or layer, the element or layer can not only be directly connected, coupled, or adhered to another element or layer, but also be indirectly connected, coupled, or adhered to another element or layer with one or more intervening elements or layers disposed or interposed between the elements or layers, unless otherwise specified.

For the expression that an element or layer "contacts," "overlaps," or the like with another element or layer, the element or layer can not only directly contact, overlap, or the like with another element or layer, but also indirectly contact, overlap, or the like with another element or layer with one or more intervening elements or layers disposed or interposed between the elements or layers, unless otherwise specified.

The term "at least one" should be understood as including any and all combinations of one or more of the associated listed items. For example, the meaning of "at least one of a first item, a second item, and a third item" denotes the combination of items proposed from two or more of the first item, the second item, and the third item as well as only one of the first item, the second item, or the third item.

The expression of a first element, a second elements "and/or" a third element should be understood as one of the first, second and third elements or as any or all combinations of the first, second and third elements. By way of example, A, B and/or C can refer to only A; only B; only C; any or some combination of A, B, and C; or all of A, B, and C.

In one or more aspects, the terms "between" and "among" may be used interchangeably simply for convenience unless stated otherwise. For example, an expression "between a plurality of elements" may be understood as among a plurality of elements. In another example, an expression "among a plurality of elements" may be understood as between a plurality of elements. In one or more examples, the number of elements may be two. In one or more examples, the number of elements may be more than two.

In one or more aspects, the terms "each other" and "one another" may be used interchangeably simply for convenience unless stated otherwise. For example, an expression "different from each other" may be understood as being different from one another. In another example, an expression "different from one another" may be understood as being different from each other. In one or more examples, the number of elements involved in the foregoing expression may be two. In one or more examples, the number of elements involved in the foregoing expression may be more than two.

Features of various embodiments of the present disclosure may be partially or wholly coupled to or combined with each other and may be variously inter-operated, linked or driven together. The embodiments of the present disclosure may be carried out independently from each other or may be carried out together in a co-dependent or related relationship. In one or more aspects, the components of each apparatus according to various embodiments of the present disclosure are operatively coupled and configured.

Unless otherwise defined, the terms (including technical and scientific terms) used herein have the same meaning as commonly understood by one of ordinary skill in the art to which example embodiments belong. It is further understood that terms, such as those defined in commonly used dictionaries, should be interpreted as having a meaning that is, for example, consistent with their meaning in the context of the relevant art and should not be interpreted in an idealized or overly formal sense unless expressly defined otherwise herein. For example, the term "part" may apply, for example, to a separate circuit or structure, an integrated circuit, a computational block of a circuit device, or any structure configured to perform a described function as should be understood by one of ordinary skill in the art.

Hereinafter, various example embodiments of the present disclosure are described in detail with reference to the accompanying drawings. For convenience of description, a scale, dimension, size, and thickness of each of the elements illustrated in the accompanying drawings may differ from an actual scale, dimension, size, and thickness, and thus, embodiments of the present disclosure are not limited to a scale, dimension, size, and thickness illustrated in the drawings.

FIG. 1 is a diagram schematically illustrating a configuration of a display device 100 according to example embodiments of the present disclosure. All the components of the display device 100 according to all embodiments of the present disclosure are operatively coupled and configured.

Referring to FIG. 1, the display device 100 may include a display panel 110, and a gate driving circuit 120, a data driving circuit 130 and a controller 140 for driving the display panel 110.

The display panel 110 may include an active area AA where a plurality of subpixels SP is disposed, and a non-active area NA which is located outside the active area AA.

A plurality of gate lines GL and a plurality of data lines DL may be arranged on the display panel 110. The plurality of subpixels SP may be located in areas where the gate lines GL and the data lines DL intersect each other.

The gate driving circuit 120 may be controlled by the controller 140, and sequentially output scan signals to the plurality of gate lines GL arranged on the display panel 110, thereby controlling the driving timing of the plurality of subpixels SP.

The gate driving circuit 120 may include one or more gate driver integrated circuits GDIC, and may be located only at one side of the display panel 110, or may be located at both sides thereof according to a driving method.

Each gate driver integrated circuit GDIC may be connected to a bonding pad of the display panel 110 by a tape automated bonding TAB method or a chip-on-glass COG method. Alternatively, each gate drive integrated circuit GDIC may be implemented by a gate-in-panel GIP method to then be directly arranged on the display panel 110. Alternatively, the gate driver integrated circuit GDIC may be integrated and arranged on the display panel 110. Alternatively, each gate driver integrated circuit GDIC may be implemented by a chip-on-film COF method in which an element is mounted on a film connected to the display panel 110.

The data driving circuit 130 may receive image data from the controller 140 and convert the image data into an analog data voltage Vdata. Then, the data driving circuit 130 may output the data voltage Vdata to each data line DL according to the timing at which the scan signal is applied through the gate line GL so that each of the plurality of subpixels SP emits light having brightness according to the image data.

The data driving circuit 130 may include one or more source driver integrated circuits SDIC.

Each source driver integrated circuit SDIC may include a shift register, a latch circuit, a digital-to-analog converter, an output buffer, and the like.

Each source driver integrated circuit SDIC may be connected to a bonding pad of the display panel 110 by a tape automated bonding TAB method or a chip-on-glass COG method. Alternatively, each source driver integrated circuit SDIC may be directly disposed on the display panel 110. Alternatively, the source driver integrated circuit SDIC may be integrated and arranged on the display panel 110. Alternatively, each source driver integrated circuit SDIC may be implemented by a chip-on-film COF method. In this case, each source driver integrated circuit SDIC may be mounted on a film connected to the display panel 110, and may be electrically connected to the display panel 110 through wires on the film.

The controller 140 may supply various control signals to the gate driving circuit 120 and the data driving circuit 130, and may control the operation of the gate driving circuit 120 and the data driving circuit 130.

The controller 140 may be mounted on a printed circuit board, a flexible printed circuit, or the like, and may be electrically connected to the gate driving circuit 120 and the data driving circuit 130 through the printed circuit board, the flexible printed circuit, or the like.

The controller 140 may allow the gate driving circuit 120 to output a scan signal according to the timing implemented in each frame. The controller 140 may convert a data signal received from the outside to conform to the data signal format used in the data driving circuit 130 and then output the converted image data to the data driving circuit 130.

The controller 140 may receive, from the outside (e.g., a host system), various timing signals including a vertical synchronization signal VSYNC, a horizontal synchronization signal HSYNC, an input data enable DE signal, a clock signal CLK, and the like, as well as the image data.

The controller 140 may generate various control signals using various timing signals received from the outside, and may output the control signals to the gate driving circuit 120 and the data driving circuit 130.

For example, in order to control the gate driving circuit 120, the controller 140 may output various gate control signals GCS including a gate start pulse GSP, a gate shift clock GSC, a gate output enable signal GOE, or the like.

The gate start pulse GSP may control the operation start timing of one or more gate driver integrated circuits GDIC constituting the gate driving circuit 120. The gate shift clock GSC, which is a clock signal commonly input to one or more gate driver integrated circuits GDIC, may control the shift timing of a scan signal. The gate output enable signal GOE may specify the timing information on one or more gate driver integrated circuits GDIC.

In addition, in order to control the data driving circuit 130, the controller 140 may output various data control signals DCS including a source start pulse SSP, a source sampling clock SSC, a source output enable signal SOE, or the like.

The source start pulse SSP may control a data sampling start timing of one or more source driver integrated circuits SDIC constituting the data driving circuit 130. The source sampling clock SSC may be a clock signal for controlling the timing of sampling data in the respective source driver integrated circuits SDIC. The source output enable signal SOE may control the output timing of the data driving circuit 130.

The display device 100 may further include a power management integrated circuit for supplying various voltages or currents to the display panel 110, the gate driving circuit 120, the data driving circuit 130, and the like or controlling various voltages or currents to be supplied thereto.

Each subpixels SP may be an area defined by a cross of the gate line GL and the data line DL, and at least one circuit element including a light-emitting element may be disposed in a subpixel SP.

For example, in the case that the display device 100 is an organic light-emitting display device, an organic light-emitting diode OLED and various circuit elements may be disposed in the plurality of subpixel SP. By controlling a current supplied to the organic light-emitting diode OLED by the various circuit elements, each subpixel may produce (or represent) a luminance corresponding to the image data.

Alternatively, in some cases, a light-emitting diode LED or micro light-emitting diode μLED may be disposed in the subpixel SP.

Figure 2A:
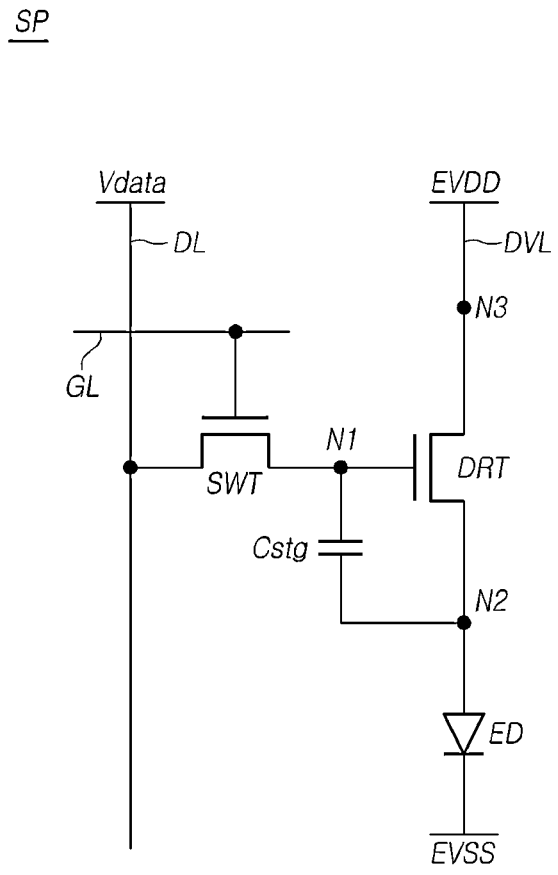
FIGS. 2A and 2B are diagrams illustrating an example of a circuit structure of a subpixel included in a display device according to example embodiments of the present disclosure.
Figure 2B:
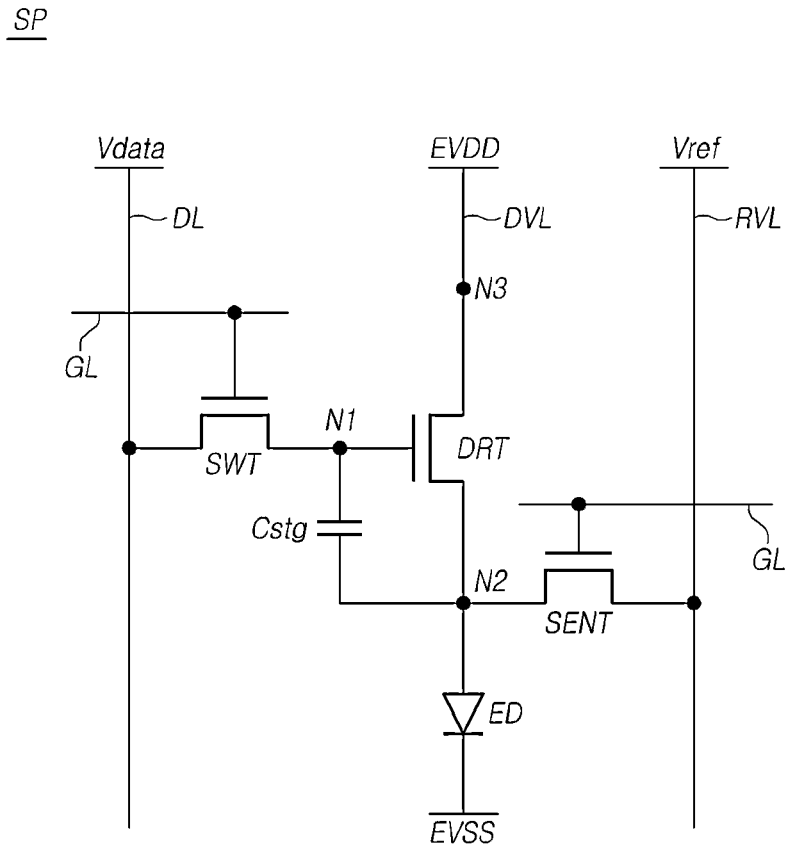

FIGS. 2A and 2B are diagrams illustrating an example of a circuit structure of a subpixel SP included in the display device 100 according to example embodiments of the present disclosure.

Referring to FIGS. 2A and 2B, a light-emitting element ED and a driving transistor DRT for driving the light-emitting element ED may be disposed in the subpixel SP. Furthermore, at least one circuit element other than the light-emitting element ED and the driving transistor DRT may be further disposed in the subpixel SP.

For example, as illustrated in FIG. 2A, a switching transistor SWT and a storage capacitor Cstg may be further disposed in the subpixel SP.

For another example, as illustrated in FIG. 2B, the switching transistor SWT, a sensing transistor SENT and the storage capacitor Cstg may be further disposed in the subpixel SP.

Thus, FIG. 2A illustrates two thin film transistors and one capacitor (which may be referred to as a 2T1C structure) other than the light-emitting element ED are disposed in the subpixel SP as an example. FIG. 2B illustrates three thin film transistors and one capacitor (which may be referred to as a 3T1C structure) other than the light-emitting element ED are disposed in the subpixel SP. But embodiments of the present disclosure are not limited to these.

Furthermore, examples illustrated in FIG. 2A and FIG. 2B illustrate that all of the thin film transistors are an N type, but in some cases, the thin film transistor disposed in a subpixel SP may be a P type.

Referring to FIG. 2A, the switching transistor SWT may be electrically connected between the data line DL and a first node N1. The data voltage Vdata may be supplied to the subpixel SP through the data line DL. The first node N1 may be a gate node of the driving transistor DRT.

The switching transistor SWT may be controlled by a scan signal supplied to the gate line GL. The switching transistor SWT may provide a control so that the data voltage Vdata supplied through the data line DL is applied to the gate node of the driving transistor DRT.

The driving transistor DRT may be electrically connected between a driving voltage line DVL and the light-emitting element ED.

A second node N2 of the driving transistor DRT may be electrically connected to the light-emitting element ED. The second node N2 may be a source node or a drain node of the driving transistor DRT.

A third node N3 of the driving transistor DRT may be electrically connected to the driving voltage line DVL. The third node N3 may be the drain node or the source node of the driving transistor DRT. A first driving voltage EVDD may be supplied to the third node N3 of the driving transistor DRT through the driving voltage line DVL. The first driving voltage EVDD may be a high potential driving voltage.

The driving transistor DRT may be controlled by a voltage applied to the first node N1. The driving transistor DRT may control a driving current supplied to the light-emitting element ED.

The storage capacitor Cstg may be electrically connected between the first node N1 and the second node N2. The storage capacitor Cstg may maintain the data voltage Vdata applied to the first node N1 during one frame.

The light-emitting element ED may be electrically connected between the second node N2 and a line that a second driving voltage EVSS is supplied. The second driving voltage EVSS may be a low potential driving voltage.

The light-emitting element ED may produce (or represent) a luminance according to the driving current supplied through the driving transistor DRT.

In this respect, the subpixel SP may further include the switching transistor SWT other than the driving transistor DRT, and may produce (or represent) a luminance according to the image data by driving the light-emitting element ED.

Alternatively, the subpixel SP may further include the sensing transistor SENT as illustrated in FIG. 2B.

The sensing transistor SENT may be electrically connected between a reference voltage line RVL and the second node N2. A reference voltage Vref may be supplied to the second node N2 through the reference voltage line RVL.

The sensing transistor SENT may be controlled by the scan signal supplied to the gate line GL. The gate line GL controlling the sensing transistor SENT may be identical to or different from the gate line GL controlling the switching transistor SWT.

The sensing transistor SENT may control that the reference voltage Vref is applied to the second node N2. Furthermore, the sensing transistor SENT, in some cases, may control that a voltage of the second node N2 is sensed through the reference voltage line RVL.

In this respect, in a structure that the sensing transistor SENT is further disposed in the subpixel SP, a luminance according to the image data may be produced (or represented) by controlling a driving of the light-emitting element ED. Furthermore, a change of a characteristic value of a circuit element disposed in the subpixel SP may be detected by the sensing transistor SENT and the reference voltage line RVL.

For the subpixel SP producing (or representing) a luminance according to the image data, an accurate control of the driving transistor DRT and the light-emitting element ED is required. However, as a driving time increases, the characteristic value of the driving transistor DRT or the light-emitting element ED may be changed due to a degradation.

For example, a threshold voltage or a mobility of the driving transistor DRT may be changed. Furthermore, a threshold voltage of the light-emitting element ED may be changed.

A variation (or deviation) of the characteristic value between the subpixels SP may occur due to a change of the characteristic value of the driving transistor DRT and the light-emitting element ED. The variation (or deviation) of the characteristic value between the subpixels SP may affect a quality of an image produced (or represented) through the display panel 110.

In the case that the sensing transistor SENT and the reference voltage line RVL are disposed in the subpixel SP, a change in the characteristic value of the subpixel SP may be sensed through the reference voltage line RVL and the change of the characteristic value may be compensated, but real time compensation can be difficult since a period for the sensing is required.

Furthermore, as illustrated in FIG. 2A, in the case of a structure in which the reference voltage line RVL is not disposed, it can be difficult to detect a change of the characteristic value of the subpixel SP.

One or more example embodiments of the present disclosure provide methods of compensating a change in the characteristic value of a circuit element disposed in a subpixel SP in real time, and preventing a decrease in display quality due to a degradation of the circuit element. In this regard, one or more example embodiments of the present disclosure provide a sensing-less compensation system (e.g., a system including a degradation management circuit 300 and a storage unit 400 illustrated in FIG. 3), which can compensate the change in the characteristic value of a circuit element in a subpixel SP without using a sensing transistor SENT or a reference voltage line RVL to sense or detect such change for the purpose of compensating such change. In one or more examples, a sensing-less compensation can compensate the change in the characteristic value of a circuit element in a subpixel SP without sensing the subpixel SP for the purpose of compensating such change.

In one or more aspects of the present disclosure, the amount of change in the characteristic value of a subpixel SP may indicate (or may be) a degradation amount of the subpixel SP. In addition, the degradation amount of the subpixel SP may indicate (or may be) the amount of change in the characteristic value of at least one of the driving transistor DRT or the light-emitting element ED disposed in the subpixel SP.

Figure 3:
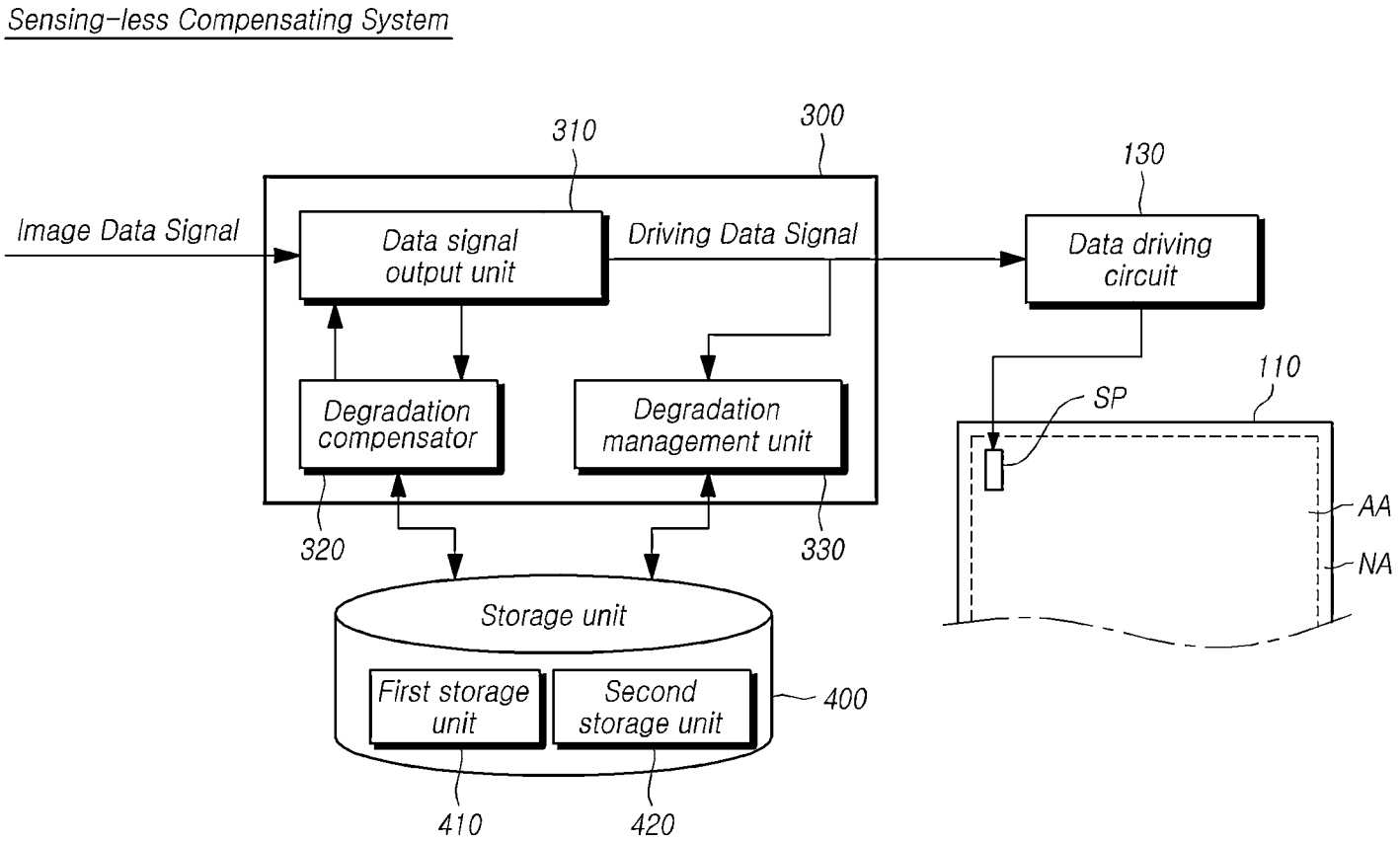
FIG. 3 is a diagram illustrating a schematic configuration of a sensing-less compensating system according to example embodiments of the present disclosure.
Figure 4:
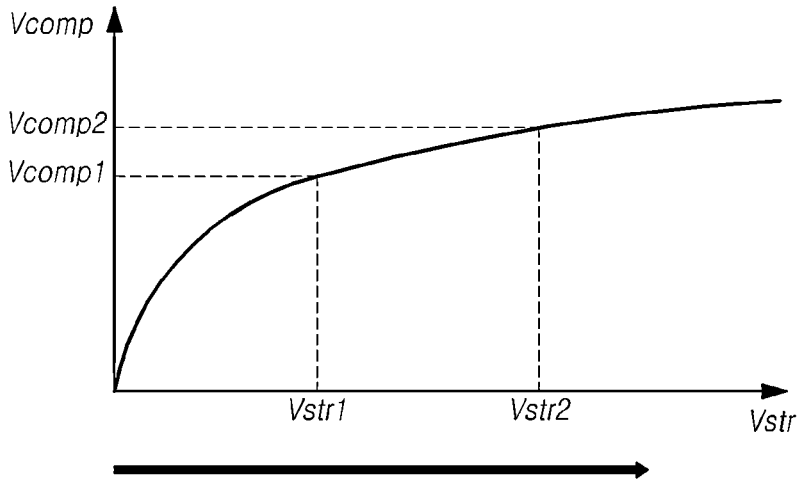
FIG. 4 is a diagram illustrating an example of real time compensation by a sensing-less compensating system according to example embodiments of the present disclosure.

FIG. 3 is a diagram illustrating a schematic configuration of a sensing-less compensating system according to example embodiments of the present disclosure. FIG. 4 is a diagram illustrating an example of real time compensation by the sensing-less compensating system according to example embodiments of the present disclosure.

Referring to FIG. 3, the sensing-less compensating system according to example embodiments of the present disclosure may include a degradation management circuit 300 and a storage unit 400. At least one of the degradation management circuit 300 or the storage unit 400 may be included in the controller 140. Alternatively, at least one of the degradation management circuit 300 or the storage unit 400 may be placed outside of the controller 140. Alternatively, in some cases, some of the components included in the degradation management circuit 300 and some of the components included in the storage unit 400 may be included in the controller 140.

The degradation management circuit 300 may include a data signal output unit 310, a degradation compensator 320 and a degradation management unit 330.

The data signal output unit 310 may receive an image data signal from outside. The data signal output unit 310 may output a driving data signal to the data driving circuit 130. The driving data signal may be produced by adding a compensation data to the image data signal.

The data signal output unit 310 may check (or obtain) the compensation data to be added to the image data signal using the degradation compensator 320.

The degradation compensator 320 may determine a degradation degree of the circuit element disposed in each of the plurality of subpixels SP based on data stored in the storage unit 400. The degradation compensator 320 may check (or determine or obtain) a compensation value corresponding to the degradation degree of the circuit element and may output the compensation value to the data signal output unit 310.

The storage unit 400 may store data representing a degradation degree of the circuit element disposed in each of the plurality of subpixels SP. Furthermore, the storage unit 400 may store data related to the compensation value corresponding to the degradation degree.

For example, the storage unit 400 may include a first storage unit 410 and a second storage unit 420.

The first storage unit 410 may store data related to the degradation degree of the circuit element which is accumulated in real time according to a driving of the subpixel SP. The data which is stored in the first storage unit 410 and is related to a real time degradation degree of each subpixel SP may be referred to as an accumulated stress data.

The second storage unit 420 may store the compensation data corresponding to the accumulated stress data. The second storage unit 420, for example, may store the compensation data corresponding to the accumulated stress data using a look-up table.

The data signal output unit 310 may check (or determine or obtain) the compensation data for the accumulated stress data of the subpixel SP using the degradation compensator 320, and may output, to the data driving circuit 130, the driving data signal which is a signal generated by adding the compensation data to the image data signal. In this respect, the driving data signal is based on the compensation data and the image data signal. In one aspect, the compensation data is reflected in the driving data signal, and the image data signal is reflected in the driving data signal.

The data driving circuit 130 may supply the data voltage Vdata according to the driving data signal to the subpixel SP. Thus, the data voltage Vdata may be supplied to the subpixel SP. In one or more aspects, the compensation data according to the degradation degree of the subpixel SP is reflected in the data voltage Vdata. In one or more aspects, the data voltage Vdata is based on the compensation data and the degradation degree of the subpixel SP.

For example, as illustrated in FIG. 4, if the accumulated stress data is a first stress value Vstr1, the driving data signal in which a first compensation value Vcomp1 corresponding to the first stress value Vstr1 is reflected may be input to the data driving circuit 130. If the accumulated stress data is a second stress value Vstr2, the driving data signal in which a second compensation data Vcomp2 corresponding to the second stress value Vstr2 is reflected may be input to the data driving circuit 130. In this regard, in one or more aspects, a driving data signal is based on a first compensation value Vcomp1 corresponding to the first stress value Vstr1. In one or more aspects, a driving data signal is based on a second compensation data Vcomp2 corresponding to the second stress value Vstr2.

The data driving circuit 130 may supply, to the subpixel SP, the data voltage Vdata in which the compensation data according to the accumulated stress data of the subpixel SP is reflected in real time. In this regard, in one or more aspects, a data voltage Vdata is based on the compensation data according to the accumulated stress data of the subpixel SP. A degradation of the circuit element disposed in the subpixel SP may be compensated in real time, and a driving of the subpixel SP may be performed.

The accumulated stress data of the subpixel SP may be updated in real time in a process that the subpixel SP is driven.

The degradation management unit 330 may receive the driving data signal that the data signal output unit 310 outputs.

As the data voltage Vdata according to the driving data signal is supplied to the subpixel SP, a degradation of the subpixel SP corresponding to the driving data signal can be progressed.

The degradation management unit 330 may update the accumulated stress data of the subpixel SP stored in the storage unit 400 according to the driving data signal.

As the accumulated stress data of the subpixel SP is updated by the degradation management unit 330 during a driving of the subpixel SP, information related to a degradation of the circuit element disposed in the subpixel SP can be updated and managed in real time.

The degradation management unit 330 may compress and store at least some of the accumulated stress data of the subpixel SP.

Figure 5:
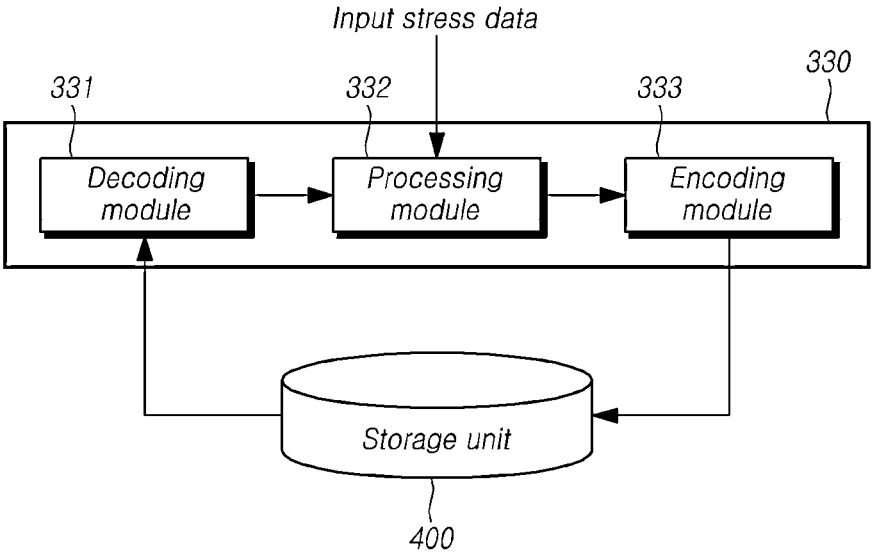
FIG. 5 is a diagram illustrating a schematic configuration of a degradation management unit of a sensing-less compensating system according to example embodiments of the present disclosure.

FIG. 5 is a diagram illustrating a schematic configuration of the degradation management unit 330 of the sensing-less compensating system according to example embodiments of the present disclosure.

Referring to FIG. 5, the degradation management unit 330 may include a decoding module 331, a processing module 332 and an encoding module 333.

The processing module 332 of the degradation management unit 330 may receive an input stress data according to a driving of the subpixel SP when the driving of the subpixel SP is performed. The input stress data may be data corresponding to the driving data signal described above, or data calculated based on the driving data signal.

The processing module 332 may update the accumulated stress data by adding the input stress data to a pre-stored accumulated stress data.

The pre-stored accumulated stress data may be stored in the storage unit 400 as compressed data.

The decoding module 331 may restore the pre-stored accumulated stress data in the storage unit 400 and output to the processing module 332.

The processing module 332 may generate an updated accumulated stress data by adding the restored accumulated stress data and the input stress data. The processing module 332 may output the updated accumulated stress data to the encoding module 333.

The encoding module 333 may compress the updated accumulated stress data and store the compressed accumulated stress data in the storage unit 400.

The encoding module 333 may lossless-compress at least some of the accumulated stress data. The encoding module 333 may loss-compress at least some of the accumulated stress data.

As the encoding module 333 performs a lossless-compression and a loss-compression together, a storage efficiency of the accumulated stress data can be improved while minimizing loss of the accumulated stress data.

Referring to FIGS. 3 and 5, in one or more aspects, the data signal output unit 310 may obtain a compensation data based on (or corresponding to) an accumulated stress data of a subpixel SP. An accumulated stress data may be sometimes referred to as a pre-stored accumulated stress data. The data signal output unit 310 may generate a driving data signal based on an image data signal and the compensation data for the subpixel SP. The data signal output unit 310 may supply the driving data signal to the data driving circuit 130. The data driving circuit 130 may generate a data voltage Vdata based on the driving data signal and may supply the data voltage Vdata to the subpixel SP in order to drive the subpixel SP. In the meantime, the degradation management unit 330 may receive an input stress data for the subpixel SP corresponding to the driving data signal and may determine, for the subpixel SP, an accumulated stress data updated based on the input stress data and the pre-stored accumulated stress data. An accumulated stress data updated may be sometimes referred to as an updated accumulated stress data.

Thereafter, the operations of the data signal output unit 310 and the data driving circuit 130 described in the foregoing paragraph may be repeated using the updated accumulated stress data. That is, in this example, the data signal output unit 310 may obtain an updated compensation data based on (or corresponding to) the updated accumulated stress data of the subpixel SP. The data signal output unit 310 may generate a second driving data signal based on an image data signal and the updated compensation data for the subpixel SP. The data signal output unit 310 may supply the second driving data signal to the data driving circuit 130. The data driving circuit 130 may generate a second data voltage Vdata based on the second driving data signal and may supply the second data voltage Vdata to the subpixel SP in order to drive the subpixel SP.

In this regard, in one or more aspects, the data voltage Vdata for the subpixel SP may be based on the driving data signal for the subpixel SP. The driving data signal for the subpixel SP may be based on the compensation data for the subpixel SP. The compensation data for the subpixel SP may be based on the accumulated stress data of the subpixel SP. Accordingly, in one or more aspects, the data voltage Vdata may be generated based on the accumulated stress data of the subpixel SP.

In this regard, in one or more aspects, the second data voltage Vdata for the subpixel SP may be based on the second driving data signal for the subpixel SP. The second driving data signal for the subpixel SP may be based on the updated compensation data for the subpixel SP. The updated compensation data for the subpixel SP may be based on the updated accumulated stress data of the subpixel SP. Accordingly, in one or more aspects, the second data voltage Vdata may be generated based on the updated accumulated stress data of the subpixel SP.

Figure 6:
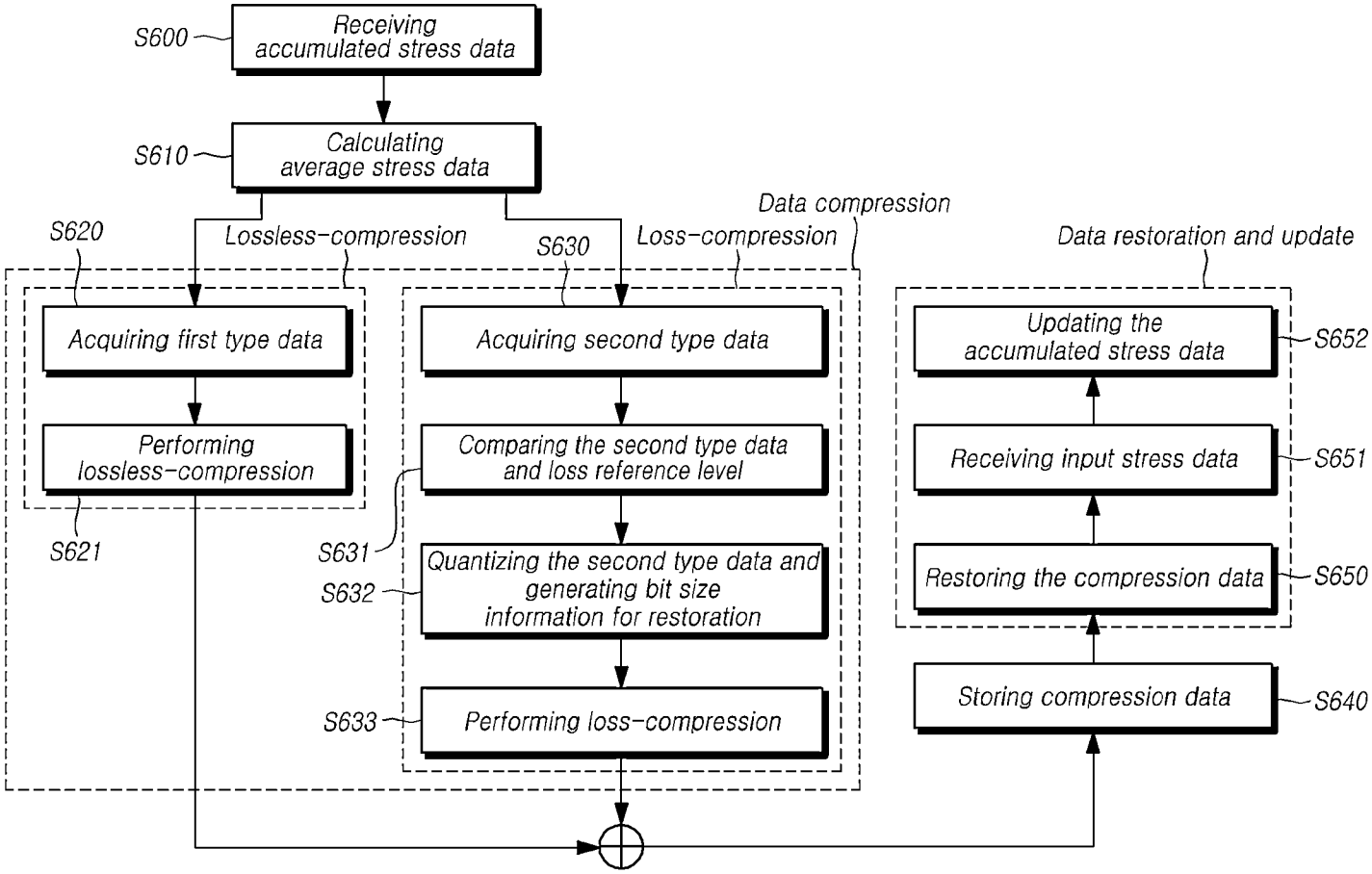
FIG. 6 is a diagram illustrating an example of a process that a sensing-less compensating system according to example embodiments of the present disclosure compresses an accumulated stress data.
Figure 7:
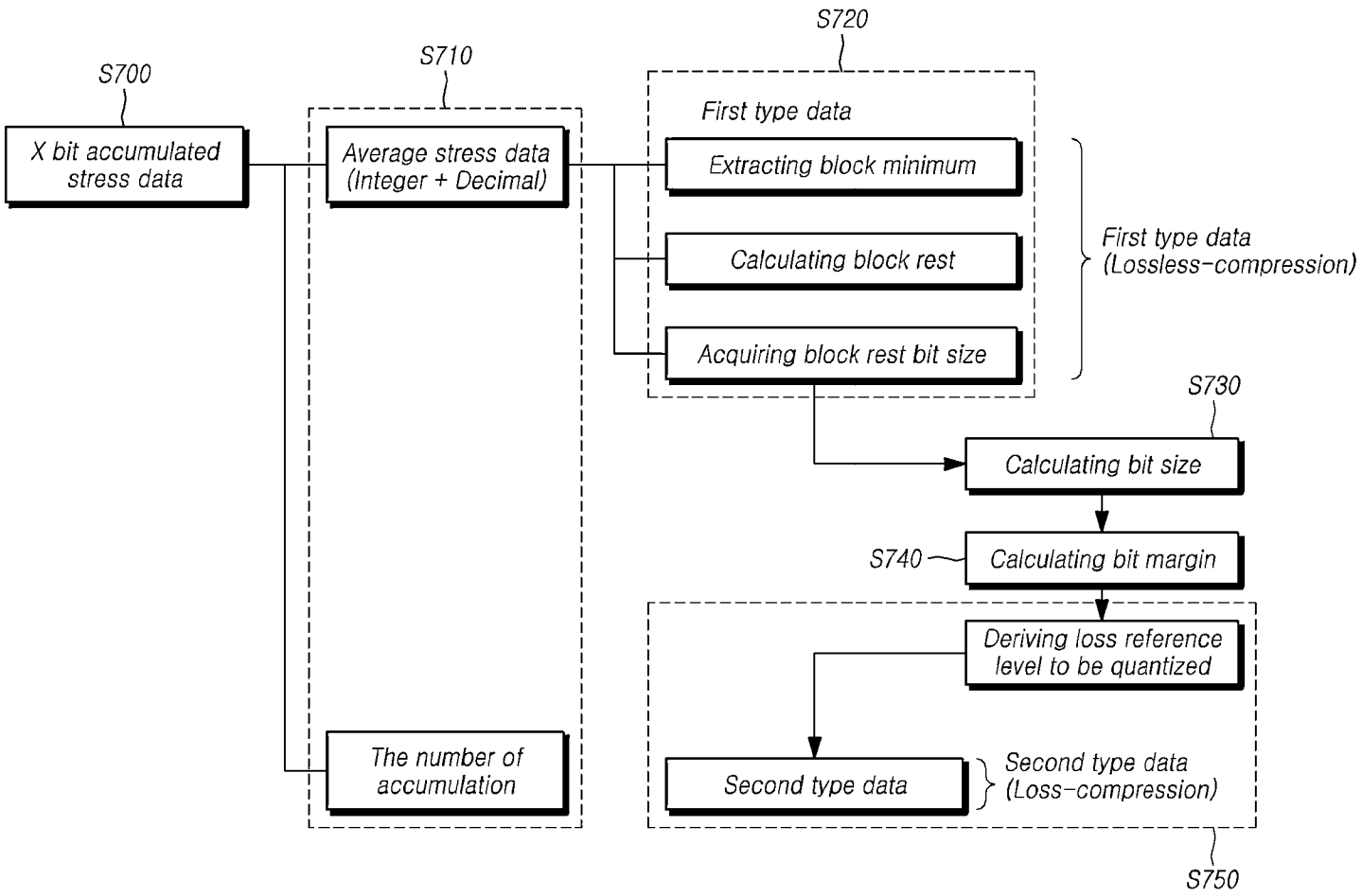
FIG. 7 is a diagram illustrating an example of a process that a sensing-less compensating system according to example embodiments of the present disclosure performs a lossless-compression and a loss-compression.

FIG. 6 is a diagram illustrating an example of a process that the sensing-less compensating system according to example embodiments of the present disclosure compresses the accumulated stress data. FIG. 7 is a diagram illustrating an example of a process that the sensing-less compensating system according to example embodiments of the present disclosure performs the lossless-compression and the loss-compression.

Referring to FIG. 6, the encoding module 333 of the degradation management unit 330 may receive the updated accumulated stress data for compressing the updated accumulated stress data at S600.

The encoding module 333 may acquire data for lossless-compressing and data for loss-compressing from the accumulated stress data. For example, the encoding module 333 may calculate an average stress data for acquiring each type of data at S610. The average stress data may be a value that the accumulated stress data is divided by the number of accumulation (e.g., the number of the accumulation operations performed).

The encoding module 333 may acquire data of a first type (which may be referred to as a first type data) to be lossless-compressed from the average stress data at S620. The first type data, for example, may be data acquired by cropping a part of the average stress data.

The encoding module 333 may lossless-compress the first type data at S621.

The encoding module 333 may acquire data of a second type (which may be referred to as a second type data) for the loss-compression based on the average stress data and the first type data or the like at S630.

The encoding module 333 may compare the second type data with a loss reference level for the loss-compression of the second type data at S631. The encoding module 333 may quantize the second type data and generate a bit size information for restoration for a restoration of the compressed second type data at S632. The encoding module 333 may loss-compress the quantized second type data at S633.

In this regard, the encoding module 333 may perform the lossless-compression and the loss-compression for the accumulated stress data. An example of the loss-compression that the encoding module 33 performs will be described later referring to FIGS. 8 and 9.

The encoding module 333 may store the first type data which is lossless-compressed and the second type data which is loss-compressed in the storage unit 400.

In a process that the accumulated stress data is updated, the decoding module 331 may restore a compressed data at S650.

The processing module 332 may receive the input stress data at S651, and may update the accumulated stress data by adding the input stress data to the restored data at S652.

As the lossless-compression and the loss-compression are performed, a storage efficiency of the accumulated stress data can be improved while minimizing loss of the accumulated stress data. A degree that the loss-compressed data is lost in the accumulated stress data may be determined according to the loss reference level. The loss reference level may be determined based on data which is lossless-compressed.

Referring to FIG. 7, the encoding module 333 may receive X bit accumulated stress data for the compression at S700. X may be a positive integer.

The encoding module 333 may acquire the average stress data, which may be obtained by dividing the accumulated stress data divided by the number of accumulation at S710. The average stress data, for example, may include an integer portion and a decimal portion.

The integer portion included in the average stress data may be lossless-compressed at S720. The integer portion included in the average stress data may be seen as the first type data. The encoding module 333 may classify a certain number of subpixels SP as one block, and may extract the minimum in the integer portion of the average stress data included in one block. The encoding module 333 may extract a block rest based on a block minimum, and acquire a bit size of the block rest.

At S730, the encoding module 333 may calculate a bit size required for the lossless-compression of the first type data using the above-mentioned process.

At S740, the encoding module 333 may calculate a bit margin based on the bit size for the lossless-compression of the first type data. The bit margin may indicate (or may be) a bit size which can be used for a data loss-compressed.

At S750, the encoding module 333 may calculate the loss reference level to quantize the second type data based on the bit margin, and may loss-compress the second type data using the calculated loss reference level. The encoding module 333, for acquiring the second type data, for example, may calculate a reconstruction data by multiplying the first type data and the number of accumulation. The encoding module 333 may calculate a value that the reconstruction data is subtracted from the X bit accumulated stress data as the second type data.

The loss reference level that the encoding module 333 calculates based on the bit margin may be constant according to an area (or within an area). For example, the loss reference level used for compressing the accumulated stress data of the subpixel SP disposed on a same line may be constant.

The accumulated stress data of the subpixel SP may be different according to a driving method of the subpixel SP, and a deviation may be present between the second type data acquired from the accumulated stress data and loss-compressed. Thus, if the loss-compression is performed by using a same loss reference level, a deviation of a loss ratio may increase according to a size of the second type data.

Embodiments of the present disclosure may provide methods of reducing a loss ratio when loss-compressing the second type data acquired from the accumulated stress data.

Figure 8:
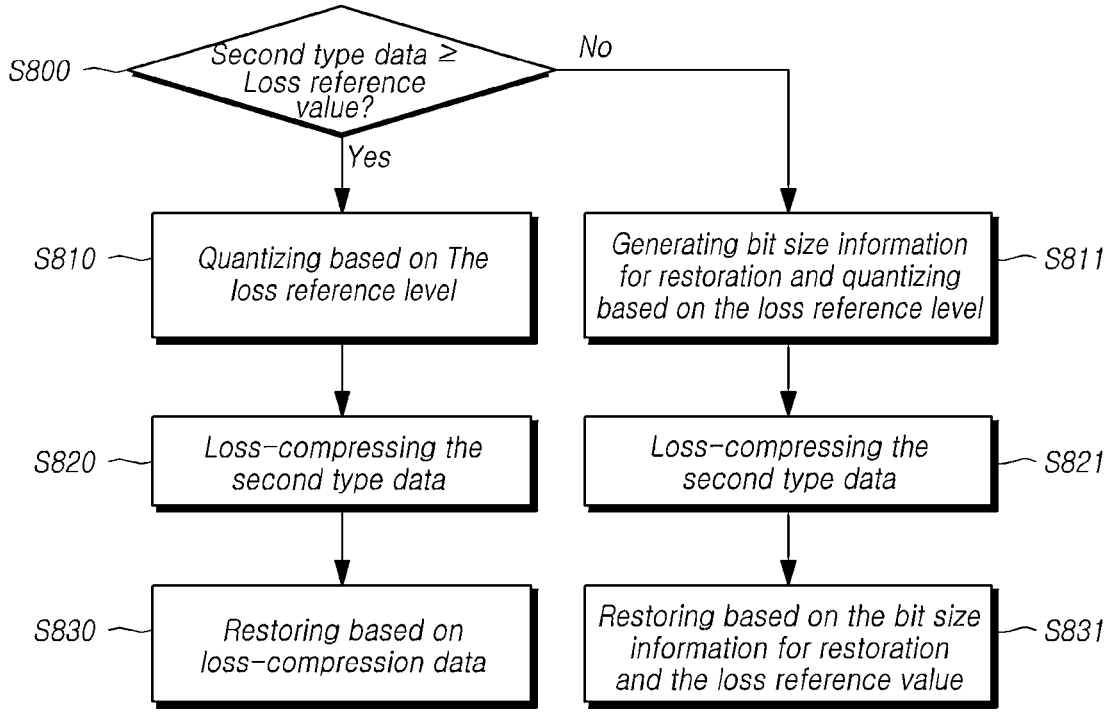
FIG. 8 is a diagram illustrating an example of a process that a sensing-less compensating system according to example embodiments of the present disclosure performs a loss-compression.
Figure 9:
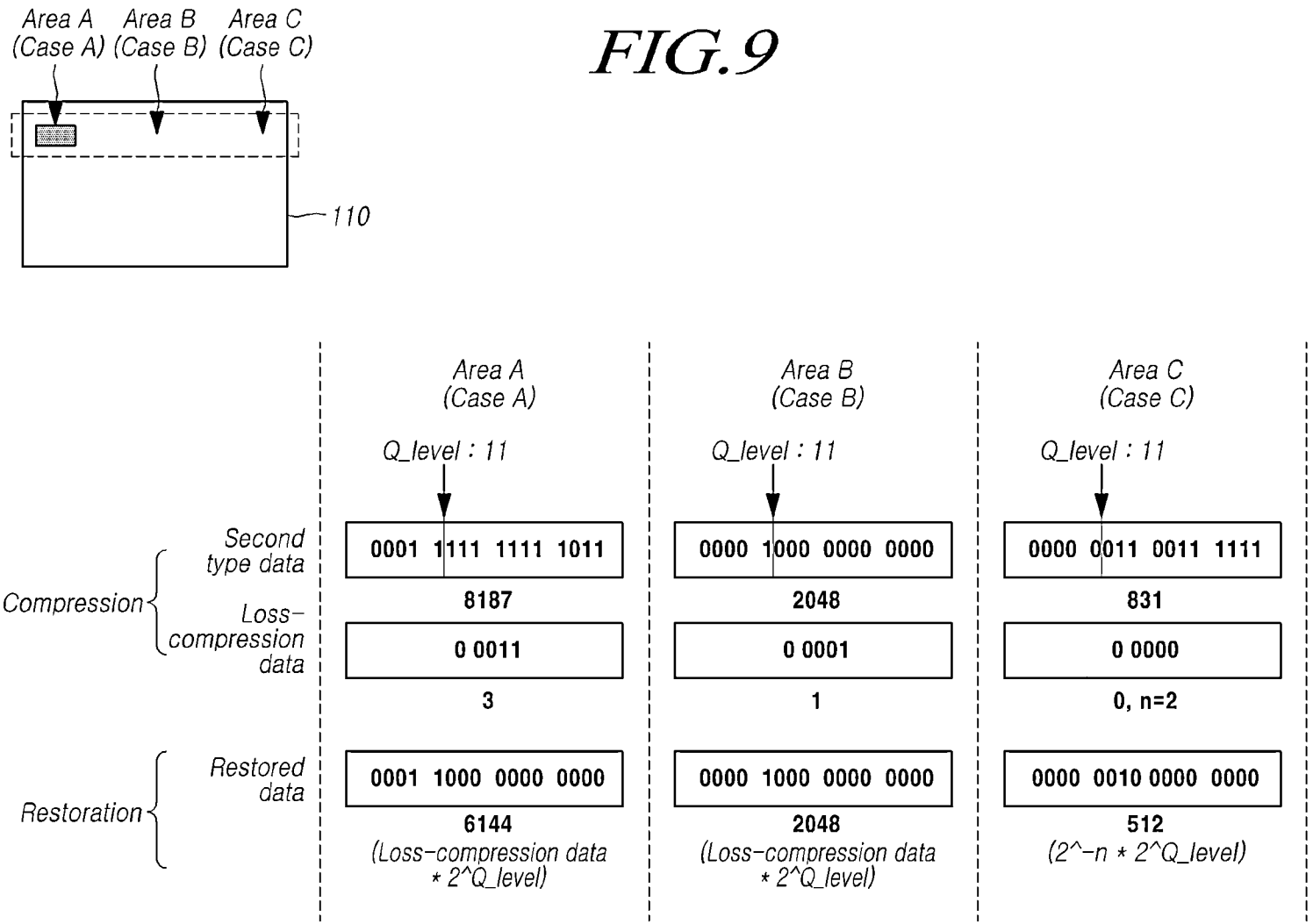
FIG. 9 is a diagram illustrating an example of a loss-compression data that a sensing-less compensating system according to example embodiments of the present disclosure performs a loss-compression and a restoration data that it restores the loss-compression data.

FIG. 8 is a diagram illustrating an example of a process that the sensing-less compensating system according to example embodiments of the present disclosure performs the loss-compression. FIG. 9 is a diagram illustrating an example of a loss-compression data that the sensing-less compensating system according to example embodiments of the present disclosure performs the loss-compression and a restoration data that it restores the loss-compression data.

Referring to FIG. 8, the encoding module 333 may compare the second type data with the loss reference value when the second type data is acquired from the accumulated stress data at S800. The loss reference value may be a value calculated based on the loss reference level acquired in a process of lossless-compressing the first type data acquired from the accumulated stress data. The loss reference value, for example, may be $2^{\wedge(loss\ reference\ level)}$.

At S810, the encoding module 333 may quantize the second type data based on the loss reference level when the second type data is equal to or greater than the loss reference value. The encoding module 333 may loss-compress the second type data quantized based on the loss reference level at S820. The decoding module 331 may perform a restoration based on the loss-compression data at S830.

As the second type data is greater than the loss reference value, even if the second type data is quantized based on the loss reference level and is loss-compressed, the loss ratio may not be great.

Thus, if the second type data is equal to or greater than the loss reference value, by loss-compressing the second type data quantized based on the loss reference level, a compression efficiency can be improved while minimizing the loss ratio.

At S811, the encoding module 333 may quantize the second type data based on the loss reference level and generate the bit size information for restoration if the second type data is smaller than the loss reference value.

In the case that the second type data is smaller than the loss reference value, the second type data quantized based on the loss reference level may be "0". Thus, the loss ratio may be great when loss-compressing.

The encoding module 333 may generate the bit size information for restoration for reducing the loss ratio when loss-compressing of the second type data smaller than the loss reference value.

The bit size information for restoration may be determined based on the most significant bit of the second type data. The bit size information for restoration may be calculated based on a bit size of the second type data and a bit size of the loss reference value.

For example, when the bit size information for restoration is n, n may be equal to the bit size of the loss reference value—the bit size of the second type data+1. In this example, n may be a positive integer.

The bit size information for restoration may be used when restoring the second type data which is loss-compressed.

The encoding module 333 may loss-compress the second type data quantized based on the loss reference level at S821.

The bit size information for restoration may be stored in a separate space associated with the second type data which is loss-compressed. Alternatively, the bit size information for restoration may be stored in a certain space such as a spare space of a header of a format of the second type data which is loss-compressed. A type of space in which the bit size information for restoration is stored and managed is not limited to a certain type, and the bit size information for restoration may be stored and managed in a space of various types which may be used for restoration of the second type data which is loss-compressed.

The decoding module 331 may restore the second type data which is loss-compressed based on the bit size information for restoration and the loss reference value at S831.

For example, the decoding module 331 may restore the second type data which is loss-compressed by shifting the loss reference value by bits according to the bit size information for restoration when restoration of the second type data which is loss-compressed.

In this regard, in the case of restoring the second type data which is loss-compressed, the restoration may be performed by a value corresponding to the most significant bit of the second type data. Thus, it can be prevented that the data is output as "0" when restoring, according to quantizing based on the loss reference level and loss-compressing.

FIG. 9 illustrates a specific example of performing the loss-compression differently according to a comparison result of the second type data and the loss reference value.

Referring to FIG. 9, a size of the second type data to be loss-compressed may be different according to an area of the display panel 110. In this regard, the loss reference level applied to the corresponding area may be identical. For example, Q_level which is the loss reference level may be constant as 11.

Case A illustrates an example of loss-compressing the second type data acquired from the accumulated stress data of the subpixel SP of an area where the degradation degree is great such as Area A.

The second type data acquired from Area A is 8187, and it may be greater than the loss reference value $2^{\wedge 11}$ calculated based on the loss reference level of 11. Thus, the second type data may be compressed as "0 0011" which is quantized based on the loss reference level of 11. When restoring, the restored data may be generated by multiplying the loss-compressed data "0 0011" and the loss reference value $2^{\wedge 11}$.

Case B illustrates an example in which the second type data acquired from Area B is 2048. The second type data is identical to the loss reference value $2^{\wedge 11}$, the second type data may be quantized based on the loss reference level 11 such as Case A. thus, the loss-compressed data may be "0 0001" in Case B. Further, when restoring, the restored data may be generated by multiplying the loss-compressed data "0 0001" and the loss reference value $2^{\wedge 11}$.

Case C illustrates an example in which the second type data acquired from Area C is 831. As the second type data is smaller than the loss reference value $2^{\wedge 11}$, in the case of quantizing based on the loss reference level 11, the loss-compressed data may be "0 0000".

In this case, the bit size information for restoration for a restoration of the loss-compressed data "0 0000" may be generated.

The bit size information for restoration may be a value that 10 which is a bit size of the second type data is subtracted from 11 which is a bit size of the loss reference value and then 1 is added to that. Thus, the bit size information for restoration may be "2". The bit size information for restoration may indicate (or may be) a gap between the most significant bit of the loss reference value and the most significant bit of the second type data.

The bit size information for restoration may be included in a certain space of a format of the loss-compression data, or may be stored in a separate space. And even in the case that the second type data is equal to or greater than the loss reference value, when the bit size information for restoration is provided by a same format, the bit size information for restoration in Case A and Case B may be "0".

In the case of Case C, when restoring the loss-compression data, the restored data may be generated based on the bit size information for restoration and the loss reference value. For example, in the case that the bit size information for restoration is 2, the restored data may be $2^{\wedge -2}*2^{\wedge Q_level}$. Thus, the restored data may be "512", a lost degree from the second type data 831 before the compression can be reduced.

In this regard, according to example embodiments of the present disclosure, as comparing the second type data which is an object of the loss-compression with the loss reference value and providing the bit size information for restoration according to the comparison result, the loss ratio can be reduced when loss-compressing.

Furthermore, as a restoration is performed by compensating a predicted loss in a restoration process for updating the accumulated stress data, a loss occurred in a process of repeating the compression and the restoration of the accumulated stress data can be reduced.

Figure 10:
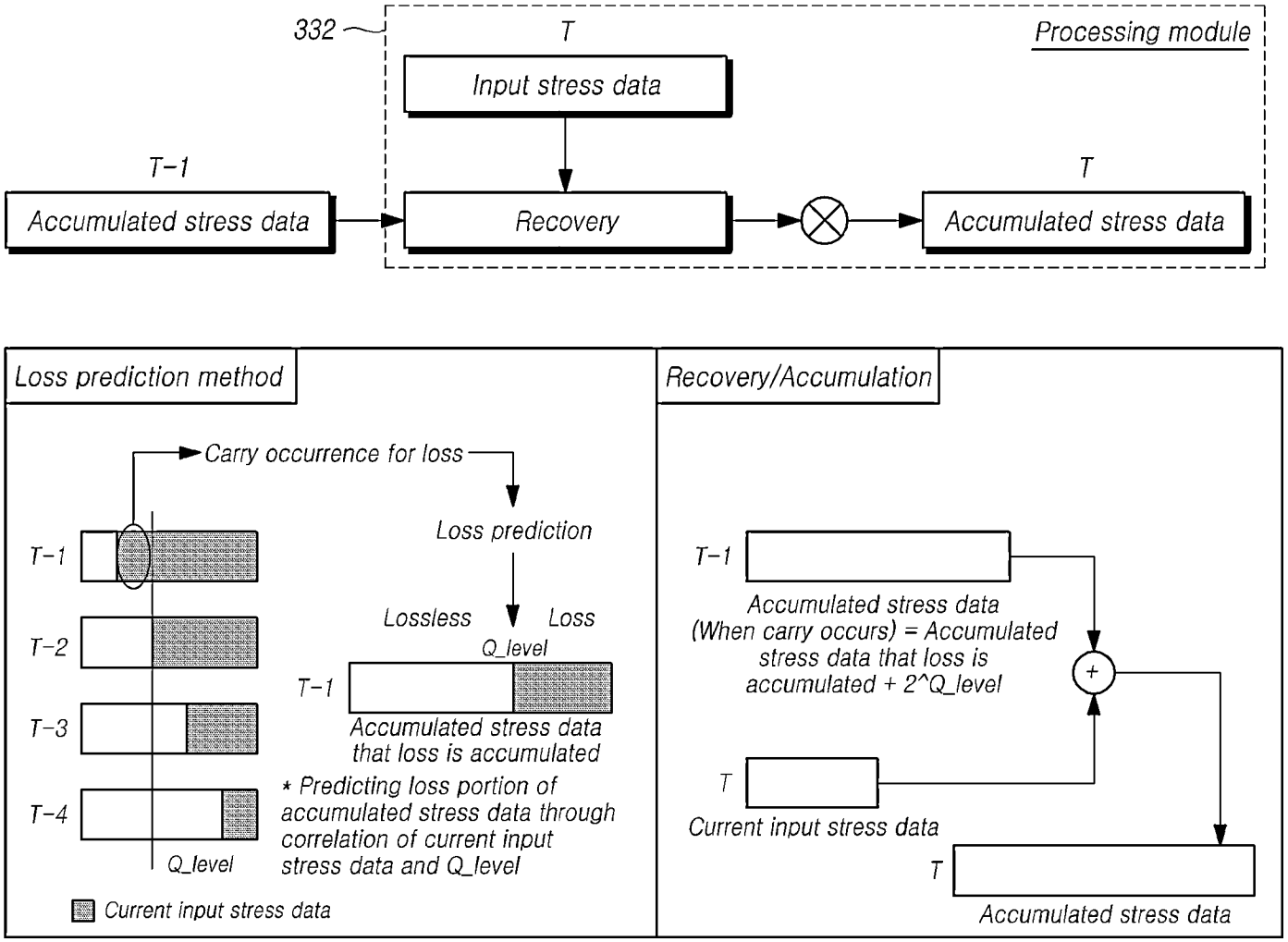
FIG. 10 is a diagram illustrating an example of a process that a sensing-less compensating system according to example embodiments of the present disclosure updates an accumulated stress data.

FIG. 10 is a diagram illustrating an example of a process that the sensing-less compensating system according to example embodiments of the present disclosure updates the accumulated stress data.

Referring to FIG. 10, the processing module 332 may generate the accumulated stress data of T time by adding the input stress data of the T time to the stored accumulated stress data at T−1 time when the input stress data is occurred at the T time.

The processing module 332 may predict a loss accumulated to the accumulated stress data based on the current input stress data in a process of restoring the accumulated stress data of the T−1 time.

For example, the processing module 332 may compare the current input stress data of each time T−4, T−3, T−2, T−1 with the loss reference value. It can be seen that the processing module 332 may compare a bit size of the current input stress data with the loss reference level Q_level.

The processing module 332 may determine that an accumulated loss is equal to or greater than the minimum loss reference value if the current input stress data is greater than the loss reference value. In this case, a carry for the loss may occur.

The processing module 332 may perform a recovery by adding $2^{\wedge Q_level}$ which is the loss reference value to the accumulated stress data of the T−1 time in a process of accumulating the input stress data of the T time when the carry for the loss occurs. The processing module 332 may generate the accumulated stress data of the T time by adding the current input stress data to the accumulated stress data of the T−1 time which the recovery is performed.

As the loss reference value is added to the accumulated stress data of the T−1 time in the recovery process, a compensation for the loss predicted in the accumulated stress data of the T−1 time may be performed.

Accordingly, a loss occurred due to a repetition of the compression and the restoration of the accumulated stress data can be reduced in a process of updating the accumulated stress data.

Various example embodiments and aspects of the present disclosure are described below for convenience. These are provided as examples, and do not limit the subject technology. Some of the examples described below are illustrated with respect to the figures disclosed herein simply for illustration purposes without limiting the scope of the subject technology.

In one or more example, the expression lossless-compressed data may refer to data that is compressed without loss of the data. In one or more example, the expression loss-compressed data may refer to data that is compressed where some of the data is lost due to compression. For example, according to loss-compressing, some bits of the data may be cut (or removed) and the remaining bits of the data may be compressed. In one or more example, loss-compressing causes loss of a greater amount of data than that of lossless-compressing.

In one or more examples, a host system may be a computer, a computer system, or a system with a processor. In one or more examples, a host system may not be included in a display panel 110. In one or more examples, a host system may be included in a display device 100. In some cases, a host system may not be included in a display device 100. In one or more examples, a host system does not include a controller 140. In one or more examples, a host system does not include a degradation management circuit 300 or a storage unit 400.

In one or more examples, a degradation management circuit 300 and/or its components may include (or may be) a processor that may be configured to execute code or instructions to perform the operations and functionality described herein and to perform calculations and generate commands. In one or more examples, each processing component of the degradation management circuit 300 (e.g., each of a data signal output unit 310, a degradation compensator 320, a degradation management unit 330, a decoding module 331, a processing module 332, and an encoding module 333) may include (or may be) a processor or one or more components of a processor. The processor of the degradation management circuit 300 and/or its components may be configured to monitor and/or control the operation of the components in the display device 100.

A processor may be, for example, a microprocessor, a microcontroller, or a digital signal processor. A processor may be implemented using, for example, an application specific integrated circuit, a field programmable gate array, a programmable logic device, a state machine, logic gates, or components or some combination of the foregoing.

One or more sequences of instructions may be stored within the degradation management circuit 300, the storage unit 400 and/or some components thereof. The storage unit 400 may include, for example, one or more memories. One or more sequences of instructions may be software or firmware stored and read from the degradation management circuit 300, the storage unit 400, or some components thereof (e.g., its/their processor(s)), or received from a host system. The storage unit 400 may be an example of a non-transitory computer readable medium on which instructions or code executable by the degradation management circuit 300 and/or its components (e.g., its/their processor(s)) may be stored. A computer readable medium may refer to a non-transitory medium used to provide instructions to the degradation management circuit 300 and/or its components (e.g., its/their processor(s)). A medium may include one or more media. A processor may include one or more processors or one or more sub-processors. A processor of the degradation management circuit 300 and/or its component may be configured to execute code, may be programmed to execute code, or may be operable to execute code, where such code may be stored in the degradation management circuit 300, the storage unit 400 and/or some components thereof.

In one or more examples, the degradation management circuit 300 and/or its components (e.g., its/their processor(s)) may perform, or may cause performing, the methods (e.g., the processes, steps, and operations) described with respect to various figures, such as FIGS. 3-10. For example, the degradation management circuit 300 and/or its components (e.g., its/their processor(s)) may perform, or may cause performing, the methods (e.g., the processes, steps, and operations) described herein or describe below.

For example, the degradation management circuit 300 and/or its components (e.g., its/their processor(s)) may perform, or may cause performing the following: calculating an accumulated stress data of each of the plurality of subpixels; classifying and compressing the accumulated stress data as a first type data which is lossless-compressed and a second type data which is loss-compressed; providing a bit size information for restoration matched to a loss-compressed data; determining the bit size information for restoration according to a comparison result between the second type data and a loss reference value for a loss-compression; calculating the bit size information for restoration based on a bit size of the second type data and a bit size of the loss reference value; restoring the loss-compressed data based on the bit size information for restoration and a bit size of the loss reference value; determining the loss reference value according to a bit margin calculated based on a bit size of data to which the first type data is lossless-compressed; updating the accumulated stress data by adding an input stress data to a pre-stored accumulated stress data; updating the accumulated stress data by adding the loss reference value and the input stress data to the pre-stored accumulated stress data; calculating an accumulated stress data updated based on an input stress data corresponding to the driving data signal and a pre-stored accumulated stress data; loss-compressing a part of the accumulated stress data updated; providing a bit size information matched to a loss-compressed data; restoring the pre-stored accumulated stress data; generating the accumulated stress data updated by adding the accumulated stress data restored and the input stress data; classifying and compressing the accumulated stress data updated as a first type data which is lossless-compressed and a second type data which is loss-compressed; restoring the loss-compressed data based on a loss reference value used for loss-compressing the loss-compressed data and the bit size information for restoration; generating the accumulated stress data updated by adding the input stress data after adding the loss reference value to the pre-stored accumulated stress data if the input stress data is greater than the loss reference value; determining the compensation data based on the accumulated stress data; classifying an accumulated stress data as a first type data for a lossless-compression and a second type data for a loss-compression; comparing the second type data with a loss reference value determined based on the first type data; and/or generating a bit size information for restoration matched to a loss-compressed data according to a comparison result of the second type data and the loss reference value.

In one or more examples, the degradation management circuit 300 and/or its components may be included in the controller 140. In one or more examples, the controller 140 and/or its components may include (or may be) a processor that may be configured to execute code or instructions to perform the operations and functionality described herein and to perform calculations and generate commands. In one or more examples, components of the controller 140 may include (or may be) processors. The processor of the controller 140 may be configured to monitor and/or control the operation of the components in the display device 100.

A display device 100 according to example embodiments of the present disclosure may include a plurality of subpixels SP in which a light-emitting element ED and a driving transistor DRT for driving the light-emitting element ED are disposed, a data driving circuit 130 configured to supply a data voltage to each of the plurality of subpixels SP, and a degradation management circuit 300 configured to calculate an accumulated stress data of each of the plurality of subpixels SP, classify and compress the accumulated stress data as a first type data which is lossless-compressed and a second type data which is loss-compressed, and provide a bit size information for restoration matched to a loss-compressed data.

The degradation management circuit 300 may determine the bit size information for restoration according to a comparison result between the second type data and a loss reference value for a loss-compression.

If the second type data is equal to or greater than the loss reference value, then the bit size information for restoration may be 0.

If the second type data is smaller than the loss reference value, then the bit size information for restoration may be greater than 0.

The degradation management circuit 300 may calculate the bit size information for restoration based on a bit size of the second type data and a bit size of the loss reference value.

The degradation management circuit 300 may restore the loss-compressed data based on the bit size information for restoration and a bit size of the loss reference value.

When the bit size information for restoration is greater than 0, the loss-compressed data may be 0.

The loss reference value applied to subpixels SP disposed on a same line among the plurality of subpixels SP may be constant.

The degradation management circuit 300 may determine the loss reference value according to a bit margin calculated based on a bit size of data which the first type data is lossless-compressed.

The degradation management circuit 300 may update the accumulated stress data by adding an input stress data to a pre-stored accumulated stress data. If the input stress data is greater than the loss reference value, the degradation management circuit 300 may update the accumulated stress data by adding the loss reference value and the input stress data to the pre-stored accumulated stress data.

The first type data may be a part of an average stress data which the accumulated stress data is divided by the number of accumulation.

The second type data may be a value obtained by subtracting the first type data and a reconstruction data based on the number of accumulation from the accumulated stress data.

The accumulated stress data of each of the plurality of subpixels may be related to the respective data voltage supplied to a corresponding one of the plurality of subpixels.

A sensing-less compensating system according to example embodiments of the present disclosure may be provided for a device 100 having a data driving circuit 130 and a plurality of subpixels SP. The sensing-less compensating system may include a data signal output unit 310 configured to receive an image data signal (e.g., from outside), generate a driving data signal based on the image data signal and a compensation data, and output the driving data signal to the data driving circuit 130, and a degradation management unit 330 configured to calculate an accumulated stress data updated based on an input stress data corresponding to the driving data signal and pre-stored accumulated stress data, loss-compress a part of the accumulated stress data updated, and provide a bit size information matched to a loss-compressed data. The data driving circuit 130 may supply, to a subpixel of the plurality of subpixels, a data voltage based on a second driving data signal. The data voltage supplied to the subpixel may be based on the accumulated stress data updated.

The degradation management unit 330 may include a decoding module 331 configured to restore the pre-stored accumulated stress data, a processing module 332 configured to generate the accumulated stress data updated by adding the accumulated stress data restored and the input stress data, and an encoding module 333 configured to classify and compress the accumulated stress data updated as a first type data which is lossless-compressed and a second type data which is loss-compressed.

The decoding module 331 may be configured to restore the loss-compressed data based on a loss reference value used for loss-compressing the loss-compressed data and the bit size information for restoration.

The processing module 332 may be configured to generate the accumulated stress data updated by adding the input stress data after adding the loss reference value to the pre-stored accumulated stress data if the input stress data is greater than the loss reference value.

The compensation data may be determined based on the accumulated stress data.

A method for compressing and applying data of a sensing-less compensating system according to example embodiments of the present disclosure may be provided for a device 100 having a plurality of subpixels SP. The method may include classifying an accumulated stress data as a first type data for a lossless-compression and a second type data for a loss-compression, comparing the second type data with a loss reference value determined based on the first type data, and generating a bit size information matched to a loss-compressed data according to a comparison result of the second type data and the loss reference value. A data voltage generated based on the accumulated stress data may be supplied to drive a subpixel of the plurality of subpixels SP.

The bit size information for restoration may be 0 if the second type data is equal to or greater than the loss reference value, and the bit size information for restoration may be greater than 0 if the second type data is smaller than the loss reference value.

According to example embodiments of the present disclosure, by updating in real time the accumulated stress data of the subpixel SP based on the driving data signal output to the data driving circuit 130, methods of performing real time compensation for the degradation of the subpixel SP may be provided.

Furthermore, by providing the bit size information for restoration according to a comparison result of the data loss-compressed and the loss reference value when compressing the accumulated stress data and using the bit size information for restoration when restoring, the loss ratio of the data loss-compressed can be reduced.

Furthermore, by performing a recovery that predicts and compensates a loss accumulated based on the loss reference value in a restoration process of the pre-stored accumulated stress data for an update of the accumulated stress data, a loss occurred in a process that the compression and the restoration of the accumulated stress data are repeated can be reduced.

The above description has been presented to enable any person skilled in the art to make, use and practice the technical features of the present disclosure, and has been provided in the context of a particular application and its requirements as examples. Various modifications, additions and substitutions to the described embodiments will be readily apparent to those skilled in the art, and the principles described herein may be applied to other embodiments and applications without departing from the scope of the present disclosure. The above description and the accompanying drawings provide examples of the technical features of the present invention for illustrative purposes. In other words, the disclosed embodiments are intended to illustrate the scope of the technical features of the present disclosure. Thus, the scope of the present disclosure is not limited to the embodiments shown, but is to be accorded the widest scope consistent with the claims. The scope of protection of the present disclosure should be construed based on the following claims, and all technical features within the scope of equivalents thereof should be construed as being included within the scope of the present disclosure.

What is claimed is:

1. A display device, comprising:

a plurality of subpixels in which a light-emitting element and a driving transistor for driving the light-emitting element are disposed;

a data driving circuit configured to supply a data voltage to each of the plurality of subpixels; and a degradation management circuit configured to calculate an accumulated stress data of each of the plurality of subpixels, classify and compress the accumulated stress data as a first type data which is lossless-compressed and a second type data which is loss-compressed, and provide a bit size information for restoration matched to a loss-compressed data, wherein the degradation management circuit is configured to determine the bit size information for restoration according to a comparison result between the second type data and a loss reference value for a loss-compression, and wherein the degradation management circuit is configured to determine the loss reference value according to a bit margin calculated based on a bit size of data to which the first type data is lossless-compressed.

2. The display device of claim 1, wherein if the second type data is equal to or greater than the loss reference value, then the bit size information for restoration is 0.

3. The display device of claim 1, wherein if the second type data is smaller than the loss reference value, then the bit size information for restoration is greater than 0.

4. The display device of claim 3, wherein the degradation management circuit is configured to calculate the bit size information for restoration based on a bit size of the second type data and a bit size of the loss reference value.

5. The display device of claim 3, wherein the degradation management circuit is configured to restore the loss-compressed data based on the bit size information for restoration and a bit size of the loss reference value.

6. The display device of claim 3, wherein when the bit size information for restoration is greater than 0, the loss-compressed data is 0.

7. The display device of claim 1, wherein the loss reference value applied to subpixels disposed on a same line among the plurality of subpixels is constant.

8. The display device of claim 1, wherein the degradation management circuit is configured to update the accumulated stress data by adding an input stress data to a pre-stored accumulated stress data, and if the input stress data is greater than the loss reference value, the degradation management circuit is configured to update the accumulated stress data by adding the loss reference value and the input stress data to the pre-stored accumulated stress data.

9. The display device of claim 1, wherein the first type data is a part of an average stress data which the accumulated stress data is divided by a number of accumulations.

10. The display device of claim 9, wherein the second type data is a value obtained by subtracting the first type data and a reconstruction data based on the number of accumulations from the accumulated stress data.

11. The display device of claim 1, wherein the accumulated stress data of each of the plurality of subpixels is related to the respective data voltage supplied to a corresponding one of the plurality of subpixels.

12. A sensing-less compensating system for a device having a data driving circuit and a plurality of subpixels, the sensing-less compensation system comprising:

a data signal output unit configured to receive an image data signal, generate a driving data signal based on the image data signal and a compensation data, and output the driving data signal to the data driving circuit; and a degradation management unit configured to calculate an accumulated stress data updated based on an input stress data corresponding to the driving data signal and a pre-stored accumulated stress data, loss-compress a part of the accumulated stress data updated, and provide a bit size information matched to a loss-compressed data, wherein:

the data driving circuit is configured to supply, to a subpixel of the plurality of subpixels, a data voltage based on a second driving data signal;

the data voltage supplied to the subpixel is based on the accumulated stress data updated, the degradation management unit comprises a decoding module configured to restore the pre-stored accumulated stress data; and the decoding module is configured to restore the loss-compressed data based on a loss reference value used for loss-compressing the loss-compressed data and the bit size information for restoration.

13. The sensing-less compensating system of claim 12, wherein the degradation management unit comprises:

a processing module configured to generate the accumulated stress data updated by adding the accumulated stress data restored and the input stress data; and an encoding module configured to classify and compress the accumulated stress data updated as a first type data which is lossless-compressed and a second type data which is loss-compressed.

14. The sensing-less compensating system of claim 13, wherein the processing module is configured to generate the accumulated stress data updated by adding the input stress data after adding the loss reference value to the pre-stored accumulated stress data if the input stress data is greater than the loss reference value.

15. The sensing-less compensating system of claim 12, wherein the compensation data is determined based on the accumulated stress data.

16. A method for compressing and applying data of a sensing-less compensating system to a device having a plurality of subpixels, the method comprising:

classifying an accumulated stress data as a first type data for a lossless-compression and a second type data for a loss-compression;

comparing the second type data with a loss reference value determined based on the first type data; and generating a bit size information for restoration matched to a loss-compressed data according to a comparison result of the second type data and the loss reference value, wherein:

a data voltage generated based on the accumulated stress data is supplied to drive a subpixel of the plurality of subpixels.

17. The method for compressing and applying the data of the sensing-less compensating system of claim 16, wherein the bit size information for restoration is 0 if the second type data is equal to or greater than the loss reference value, and the bit size information for restoration is greater than 0 if the second type data is smaller than the loss reference value.

18. A sensing-less compensating system for a device having a data driving circuit and a plurality of subpixels, the sensing-less compensation system comprising:

a storage unit configured to store accumulated stress data representing a degradation degree of a circuit element disposed in each of the plurality of subpixels;

a degradation compensator configured to determine a degradation degree of the circuit element disposed in each of the plurality of subpixels based on data stored in the storage unit, obtain a compensation value corresponding to the degradation degree of the circuit element, and output the compensation value; and a degradation management unit configured to calculate an accumulated stress data updated based on an input stress data corresponding to a driving data signal and a pre-stored accumulated stress data in the storage unit, loss-compress a part of the accumulated stress data updated, and provide a bit size information matched to a loss-compressed data, wherein if the input stress data is greater than a loss reference value, the degradation management unit is configured to update the accumulated stress data by adding the loss reference value and the input stress data to the pre-stored accumulated stress data.

* * * * *